US007726756B2

(12) United States Patent
Fu

(10) Patent No.: US 7,726,756 B2
(45) Date of Patent: Jun. 1, 2010

(54) REFRIGERATOR WITH VARYING WIDTH COMPARTMENTS AND UNIFORM WIDTH DOORS

(75) Inventor: Xiaoyong Fu, Plano, TX (US)

(73) Assignee: Maytag Corporation, Benton Harbor, MI (US)

( * ) Notice: Subject to any disclaimer, the term of this patent is extended or adjusted under 35 U.S.C. 154(b) by 1149 days.

(21) Appl. No.: 11/312,407

(22) Filed: Dec. 21, 2005

(65) Prior Publication Data

US 2007/0138925 A1 Jun. 21, 2007

(51) Int. Cl.
*A47B 96/04* (2006.01)

(52) U.S. Cl. ..... 312/405; 312/401

(58) Field of Classification Search ..... 312/401, 312/404, 405, 406, 407, 407.1, 116; 62/440, 62/441, 442, 443, 446; 49/501; D15/79, D15/81, 85, 91

See application file for complete search history.

(56) References Cited

U.S. PATENT DOCUMENTS

| | | | | | |
|---|---|---|---|---|---|
| 2,040,634 | A | * | 5/1936 | Sekyra | 62/382 |
| 2,492,601 | A | * | 12/1949 | Steel | 62/443 |
| 2,509,611 | A | * | 5/1950 | Philipp | 62/444 |
| 2,541,453 | A | * | 2/1951 | West | 62/161 |
| 3,070,852 | A | * | 1/1963 | Hilliker | 49/366 |
| 4,288,135 | A | * | 9/1981 | Buchser et al. | 312/296 |
| 5,211,462 | A | | 5/1993 | Bien et al. | |
| 5,269,601 | A | * | 12/1993 | Williams et al. | 312/406.1 |
| D358,598 | S | | 5/1995 | Edman | |
| 5,568,712 | A | | 10/1996 | Jenkins et al. | |
| 5,588,731 | A | | 12/1996 | Schmidt et al. | |
| D379,095 | S | | 5/1997 | Sparks | |
| D387,779 | S | | 12/1997 | Weiss et al. | |
| D418,845 | S | | 1/2000 | Jackovin | |
| 6,019,447 | A | | 2/2000 | Jackovin | |
| D431,577 | S | | 10/2000 | Jackovin | |
| D456,032 | S | | 4/2002 | Du et al. | |
| 6,375,291 | B1 | | 4/2002 | Nam et al. | |
| D508,502 | S | * | 8/2005 | Moseley | D15/91 |
| 6,926,379 | B1 | | 8/2005 | Grace et al. | |
| 7,008,032 | B2 | * | 3/2006 | Chekal et al. | 312/405 |
| 2005/0218767 | A1 | | 10/2005 | Jeong et al. | |

* cited by examiner

*Primary Examiner*—James O Hansen
(74) *Attorney, Agent, or Firm*—Kirk W. Goodwin; Diederiks & Whitelaw PLC

(57) ABSTRACT

A side-by-side refrigerator includes fresh food and freezer compartments each having upper and lower sections which vary in width and volume. The fresh food and freezer compartments are separated by a dividing wall or mullion having first and second upright portions interconnected by a laterally offset section. Fresh food and freezer doors are pivotally mounted about respective vertical axes for sealing the fresh food and freezer compartments. Each of the fresh food and freezer doors has a substantially uniform width. With this construction, the varying width compartments are sealed by substantially uniform width fresh food and freezer doors.

17 Claims, 3 Drawing Sheets

REFRIGERATOR WITH VARYING WIDTH COMPARTMENTS AND UNIFORM WIDTH DOORS

BACKGROUND OF THE INVENTION

1. Field of the Invention

The present invention pertains to the art of refrigerators and, more particularly, to a side-by-side refrigerator including laterally spaced fresh food and freezer compartments, each having upper and lower storage sections of differing widths and a substantially uniform width door.

2. Discussion of the Prior Art

In a conventional side-by-side refrigerator, freezer and fresh food compartment doors align along a vertically extending divider wall or mullion, with the mullion extending in a single plane essentially from the top to the bottom of the refrigerator. Although this style of refrigerator has certain advantages over top-mount refrigerators wherein the freezer compartment is arranged vertically above the fresh food compartment, certain disadvantages are also presented. For instance, since the opening provided in a household kitchen for both side-by-side and top-mount style refrigerators is essentially standard, top-mount refrigerators typically have wider shelves in each of the fresh food and freezer compartments as compared to corresponding shelves in a side-by-side refrigerator.

For this reason it is often difficult, if not impossible, to accommodate rather wide food items, such as trays, cake pans, platters, turkeys and the like, on a given shelf in the fresh food compartment of a side-by-side refrigerator, while the same item(s) could be readily placed on corresponding shelves in a top-mount refrigerator. The same is true with respect to the width of freezer shelves. For example, it is often difficult to store frozen pizza and other large food items widthwise in a side-by-side refrigerator freezer compartment, while such items can be easily arranged in a freezer compartment of a top-mount refrigerator. To compensate for this disadvantage, it is not uncommon for owners of side-by-side refrigerators to purchase a second refrigerator for additional food storage space. Similar comparisons could be made between side-by-side and bottom mount refrigerators.

Alternatively, a side-by-side refrigerator can be constructed, as demonstrated in U.S. Pat. No. 6,019,447, having fresh food and freezer compartments of varying widths. In this manner, a consumer can arrange larger width items in a larger width area of the refrigerator, while small width items can be placed on shelves located in a narrower or standard width section. In order to maintain a temperature within each of the varying width compartments, the refrigerator illustrated in the '447 patent includes fresh food and freezer doors having varying widths that correspond to the widths of the fresh food and freezer compartments. As such, each of the fresh food and freezer doors includes first and second inner longitudinal portions interconnected by a laterally offset section.

The refrigerator constructed in accordance with the '447 patent evinces advantages of top and bottom mount refrigerators, e.g. wider available storage spaces, into a side-by side model. However, this novel design may not be pleasing to every type of consumer. Many consumers have grown accustomed to seeing a vertical split or division between the doors on a side-by-side refrigerator. The laterally offset split of the '447 refrigerator is quite distinct and, perhaps too modern for the tastes of some consumers. Thus, if the consumer is unwilling to accept the modern appearance, that consumer will be unable to take advantage of many features of a side-by-side refrigerator having varying width compartments.

SUMMARY OF THE INVENTION

The present invention is directed to a side-by-side refrigerator having both varying width fresh food and freezer compartments and doors having substantially uniform widths so as to provide a more conventional, outward appearance. In accordance with a preferred embodiment of the invention, the fresh food compartment is wider in an upper section than in a lower section, while the freezer compartment is wider in a lower section than in an upper section. With this construction, shelves supported in the upper section of the fresh food compartment are laterally elongated as compared to corresponding shelves in a standard side-by-side refrigerator. The fresh food and freezer compartments are separated by a fore-to-aft extending divider wall. The divider wall includes first and second interconnected upright portions, which are laterally offset, to establish the varying lateral dimensions of the fresh food and freezer compartments.

In particular accordance with the invention, the refrigerator is provided with fresh food and freezer doors, with each of the fresh food and freezer doors including first and second, substantially parallel, side edge portions that are joined by a top edge portion and a bottom edge portion in a manner which establishes a substantially uniform width from top to bottom. In a manner known in the art, each of the doors is pivotal about a respective vertical axis. To accommodate covering the varying width compartments with substantially uniform width doors, the freezer door preferably extends across the freezer compartment, as well as a portion of the fresh food compartment.

In still further accordance with the most preferred embodiment of the present invention, the divider wall is constituted by a mullion having a front surface and a laterally extending segment that interconnects the first and second upright portions. The front surface of the mullion provides a sealing portion for the fresh food and freezer doors. Actually, in the most preferred embodiment of the invention, the freezer door seals against the first upright portion, the second upright portion and the laterally extending segment, while the fresh food door simply seals against the second upright section. In order to provide additional sealing of the fresh food door, the freezer door is provided with a pivoting panel that mates with the fresh food door and prevents air from escaping the fresh food compartment.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
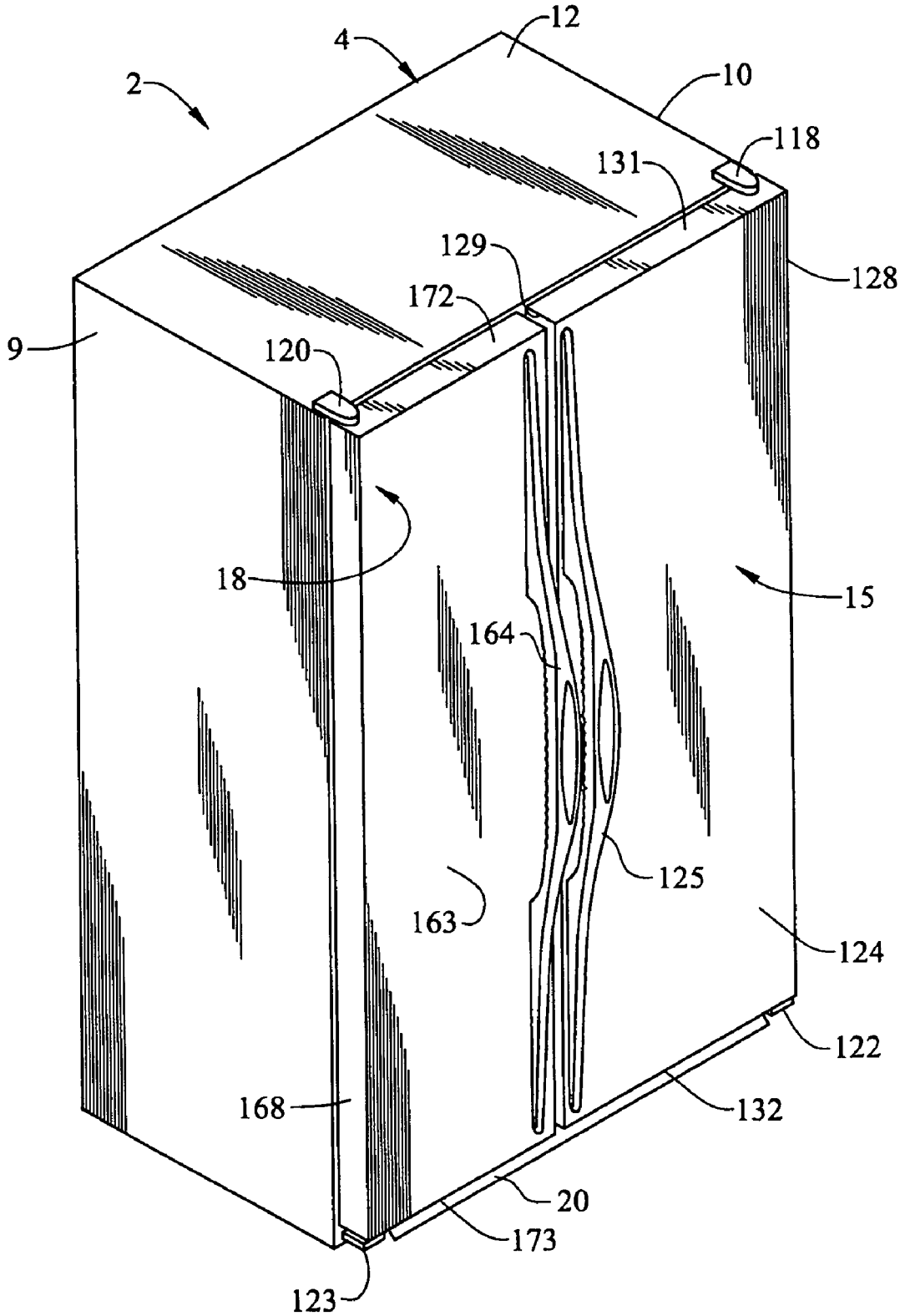
FIG. 1 is an upper left perspective view of a side-by-side refrigerator constructed in accordance with the present invention.

With initial reference to FIG. 1, a side-by-side refrigerator constructed in accordance with the present invention is generally indicated at 2. In general, refrigerator 2 includes a cabinet shell 4 formed from side panels 9 and 10 which are interconnected by a top panel 12. Preferably, cabinet shell 4 is formed from bending a single piece of sheet metal in a manner known in the art. As shown, refrigerator 2 is provided with a fresh food door 15 which is arranged laterally juxtaposed a freezer door 18. Extending laterally across cabinet shell 4, below fresh food and freezer doors 15 and 18 is a kick plate 20. Kick plate 20 is provided with a plurality of vents 22 (see FIGS. 2 and 3) that provide ventilation to refrigeration components (not shown).

Figure 2:
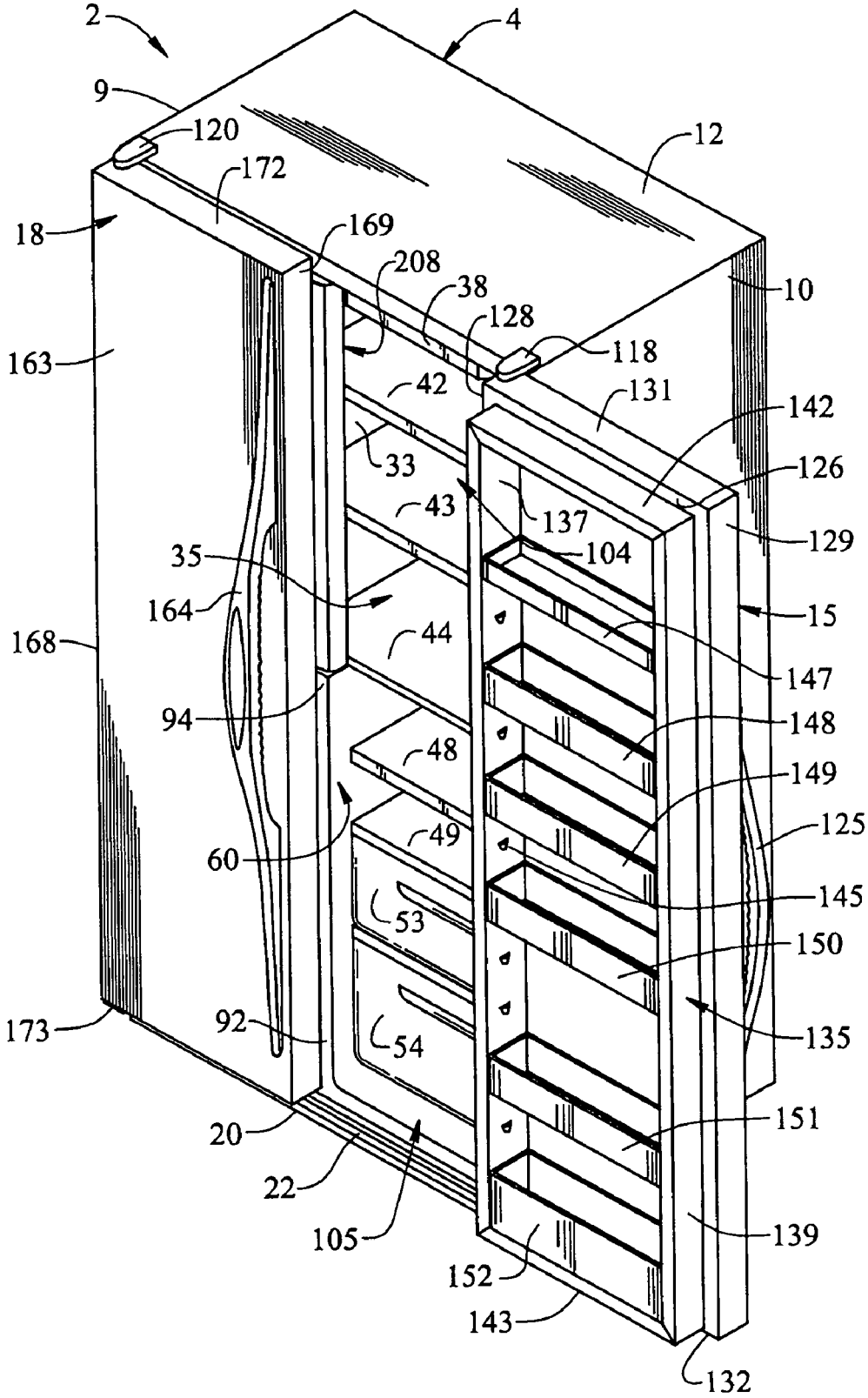
FIG. 2 is an upper right perspective view of the side-by-side refrigerator of FIG. 1 with an open fresh food door.
Figure 3:
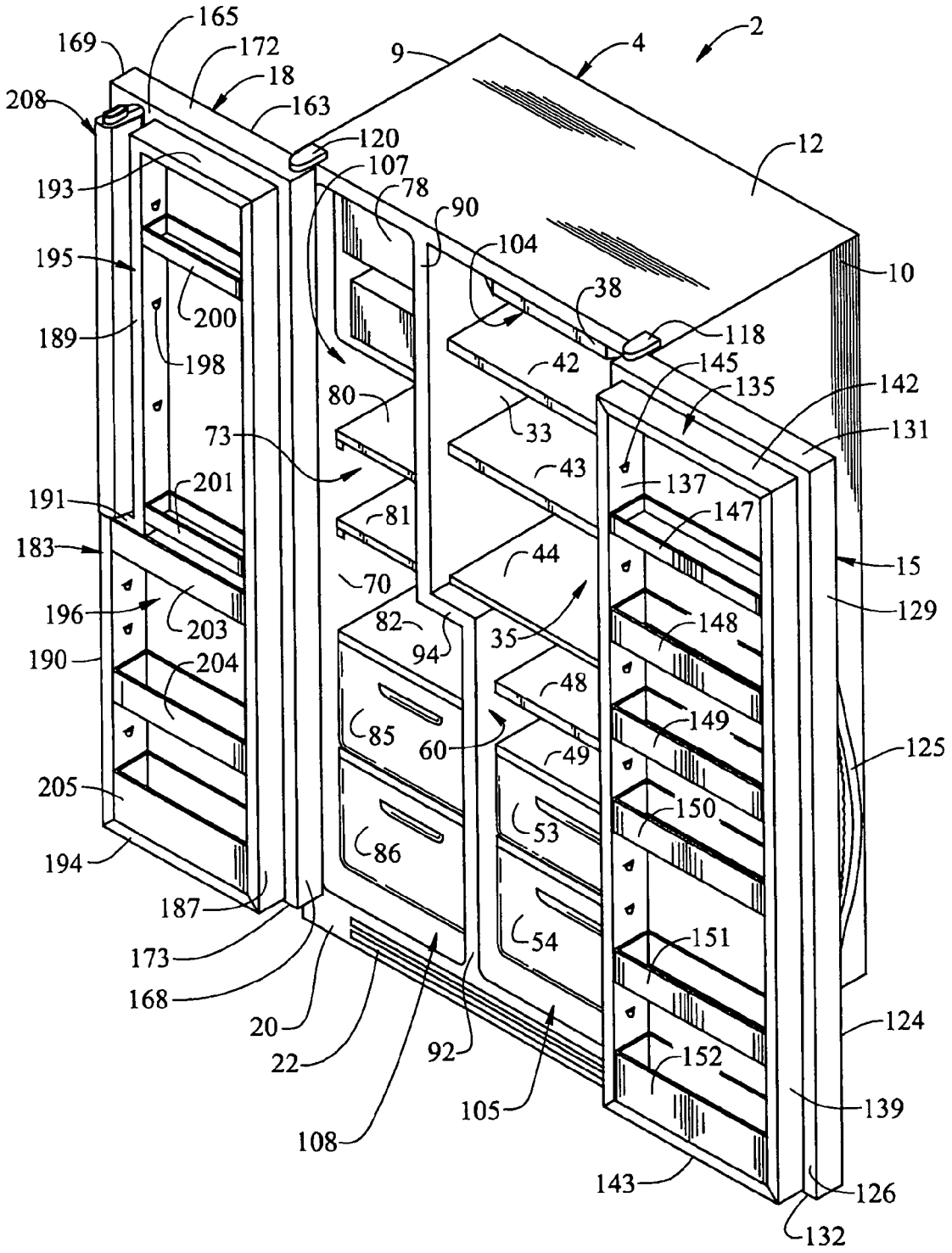
FIG. 3 is an upper right perspective view of the refrigerator of FIG. 2 with both the fresh food and freezer doors open.

With further reference to FIGS. 2 and 3, cabinet shell 4 has mounted therein a liner 33 which defines a fresh food compartment 35. For the sake of completeness, a temperature control unit 38 is shown mounted atop fresh food compartment 35. In addition, fresh food compartment 35 is provided with a plurality of vertically adjustable shelves 42-44 having a first width and a second plurality of vertically adjustable shelves 48 and 49 having a second, narrower width. Finally, FIGS. 2 and 3 indicate the presence of lowermost, slidable storage bins 53 and 54 in fresh food compartment 35.

Except for varying in width from typical side-by-side fresh food compartment shelves and bins, the construction and mounting of shelves 42-44, 48 and 49, as well as bins 53 and 54, is generally known in the art. That is, shelves 42-44, 48 and 49 are typically supported on rails (not shown) that extend along a rear portion of fresh food compartment 35 between an outer wall (not separately labeled) of liner 33 and a dividing wall or mullion 60.

In a similar manner as illustrated in FIG. 3, a freezer liner 70 is mounted within cabinet shell 4 so as to define a freezer compartment 73. In the embodiment shown, freezer compartment 73 has mounted therein an icemaker 78, various vertically spaced shelves 80-82, and lowermost slidable bins 85 and 86. Again, all of these food item supporting units are known in the art and have simply been sized to correspond to the variations in width of the different storage sections in accordance with the present invention. Most importantly, it should be realized that fresh food and freezer compartments 35 and 73 have varying width sections. Accordingly, mullion 60 takes on a different configuration than that found in conventional side-by-side refrigerators. More specifically, mullion 60 includes an upper vertical portion 90 and a lower vertical portion 92 which are interconnected by a laterally extending portion 94.

In the most preferred form of the invention, an upper section 104 of fresh food compartment 35, as defined by liner 33, has been widened as compared to a conventional side-by-side refrigerator. In addition, a lower section 105 of fresh food compartment 35 has been narrowed in width. Correspondingly, an upper section 107 of freezer compartment 73 has been narrowed and a lower section 108 has been widened as compared to a conventional side-by-side refrigerator. With this configuration, upper section 104 of fresh food compartment 35 and lower section 108 of freezer compartment 73 can accommodate larger food items than could previously fit in a corresponding section of a conventional side-by-side refrigerator. However, the overall available volume of both the fresh food and freezer compartments 35 and 73, in accordance with the present invention, need not deviate from that of a conventional side-by-side refrigerator. Of course, the volumes could be varied as desired, such as by simply widening an upper section of the fresh food compartment 35, while corresponding reducing the volume of the freezer compartment 73. In any event, the overall outer dimensions of refrigerator 2 remain the same as on a conventional side-by-side refrigerator in accordance with the preferred form of the invention such that refrigerator 2 can fit within a standard sized refrigerator opening provided in a household kitchen. Actually, this internal configuration for refrigerator 2 is known in the art as disclosed in U.S. Pat. No. 6,019,447 entitled "Refrigerator With Varying Width Fresh Food and Freezer Compartments" which is incorporated herein by reference.

In accordance with the present invention, while fresh food and freezer compartments 35 and 73 are provided with varying widths, fresh food and freezer doors 15 and 18 have a conventional configuration or, more specifically, have substantially uniform widths. That is, a consumer, viewing an outside of refrigerator 2 as shown in FIG. 1, with doors 15 and 18 closed, would not be aware of the varying width compartments 35 and 73 which are hidden behind doors 15 and 18. As shown, fresh food door 15 and freezer door 18 are pivotable about respective vertical axes as defined by upper hinges 118 and 120 respectively, as well as lower hinges 122 and 123. In further accordance with the preferred embodiment shown, fresh food door 15 includes a front face portion 124 provided with a handle 125, a rear face portion 126, and opposed, substantially parallel, side panel portions 128 and 129 that are interconnected by a top panel portion 131 and a bottom panel portion 132.

As shown in FIGS. 2 and 3, provided on rear face portion 126 is a dike member 135. Dike member 135 includes an inner dike section 137 that extends along side panel portion 128, an outer dike section 139 which is interconnected to inner dike section 137 by an upper dike section 149, and a lower dike section 143. In a manner known in the art, inner and outer dike sections 137 and 139 are provided with a plurality of support members, indicated generally at 145, for retaining storage shelves on door 15. Thus, in accordance with the embodiment shown, fresh food door 15 is provided with a plurality shelves 147-152 that can be selectively, vertically positioned between inner and outer dike members 137 and 139. Dike member 135 is adapted to nest within the narrow portion of fresh food compartment 35 and thus is provided with an outer peripheral seal (not shown) along rear face portion 126 that is arranged to abut lower vertical portion 92 of mullion 60, as well as an outer front face portion (not separately labeled), of cabinet shell 4 to prevent cool air from escaping refrigerator 2.

In a similar manner, freezer door 18 includes a front face portion 163 provided with a handle 164, a rear face portion 165, laterally opposed, substantially parallel, side panel portions 168 and 169 that are interconnected by a top panel portion 172, and a bottom panel portion 173. Arranged on rear face portion 165 is a dike member 183 including an inner vertical section 187 that extends along side panel portion 168, first and second vertically offset outer vertical sections 189 and 190 that are interconnected by a laterally extending section 191, an upper dike member 193 and a lower dike member 194. Inner vertical section 187 is interconnected to first vertically offset outer vertical section 189 through upper dike section 193 and, in a similar manner, inner vertical section 187 is connected to second vertically offset outer vertical section 190 through lower dike section 194. Thus, dike member 183 includes an upper, narrow portion 195 and a lower, wider portion 196.

With this arrangement, when freezer door 18 is moved to a closed position, upper, narrow portion 195 of dike member 183 nests within upper portion 107 of freezer compartment 73 and lower, wider portion 196 of dike member 183 nests within lower wider portion 196 of freezer compartment 73. In addition, freezer door 18 is provided with a peripheral seal (not shown) that seats against front panel portions (not separately labeled) of cabinet shell 4, as well as upper vertical portion 90, lower vertical portion 92 and laterally extending portion 94 of mullion 60. Inner vertical section 187, as well as first and second vertically offset sections 189 and 190 of dike member 183 are provided with a plurality of support members indicated generally at 198 for supporting various food storage shelves. More specifically, upper narrow portion 195 is shown provided with a plurality of narrow shelves 200 and 201, while lower, wider portion 196 is shown provided with a plurality of wider shelves 203-205. With this arrangement, shelves 200, 201 and 203-205 are selectively, vertically adjustable so as to be tailored to the particular needs of a consumer.

In any event, with this particular construction, while freezer compartment 73 is completely sealed about dike member 183, upper portion 104 of fresh food compartment 35 includes an unsealed area that could enable cool air to escape from refrigerator 2. However, in accordance with the most preferred embodiment of the present invention, an upper outer portion (not separately labeled) of freezer door 18 is provided with an interior panel 208 that extends between top panel 172 and laterally extending section 191 of dike member 183. Thus, at least when freezer door 18 is in the closed position, fresh food door 15 will seal against lower vertical portion 92 of mullion 60, as well as panel 208. In further accordance with the most preferred embodiment of the present invention, in order to enable freezer door 18 to be selectively opened without requiring the opening of fresh food door 15, panel 208 is, preferably, pivotable about a vertical axis. In this manner, when freezer door 18 is moved to an open position, panel 208 pivots aside, thereby allowing freezer door 18 to open without obstruction. Although various pivoting systems could be employed, panel 208 is preferably mounted and pivoted in a manner disclosed in U.S. patent application Ser. No. 10/650,723 entitled "Refrigerator Incorporating French Doors with Rotating Mullion Bar" filed Aug. 29, 2003 which is incorporated herein by reference.

At this point, it should be understood that the present invention provides a unique closing arrangement for refrigerator 2. That is, while fresh food and freezer compartments 35 and 73 are provided with varying widths, fresh food door and freezer doors 15 and 18 at least appear to have substantially rectangular designs found in conventional side-by-side refrigerators. Therefore, the present invention enables a consumer to avail himself of the various advantageous features of varying width fresh food and freezer compartments, while maintaining a standard or conventional outward appearance of the refrigerator. Although described with reference to a preferred embodiment of the present invention, it should be readily apparent to one of ordinary skill in the art that various changes and/or modifications can be made to the invention without departing from the spirit thereof. For instance, although the use of the pivoting interior panel for sealing purposes is preferred, it should be realized that various other arrangements could be employed, such as laterally extending magnetic seals between the dike or other portions of the fresh food and freezer doors. In general, the invention is only intended to be limited to the scope of the following claims.

I claim:

1. A refrigerator comprising:

a cabinet shell including a pair of laterally spaced side panels, a top panel interconnecting upper edge portions of the side panels, and an open frontal zone permitting access to within the cabinet shell;

at least one liner positioned within the cabinet shell, said at least one liner defining laterally spaced, fresh food and freezer compartments separated by a fore-to-aft extending divider wall, said divider wall including at least first and second interconnected upright portions which are laterally offset, wherein each of the fresh food and freezer compartments has varying lateral dimensions; and fresh food and freezer doors each including first and second, substantially parallel, side edge portions joined by a top edge portion and a bottom edge portion, each of said doors being pivotally mounted relative to the cabinet shell about a vertical axis, wherein, when the fresh food and freezer doors are in closed positions, the freezer door completely seals the freezer compartment, a portion of the freezer door extends beyond the divider wall when closed such that opening of the freezer door exposes at least a portion of each of the fresh food and freezer compartments, and the freezer door includes an element to which the fresh food door, when closed, engages in sealing off the fresh food compartment.

2. The refrigerator according to claim 1, wherein each of the fresh food and freezer compartments includes upper and lower sections, with the upper section of the fresh food compartment being wider than the lower section of the fresh food compartment and with the lower section of the freezer compartment being wider than the upper section of the freezer compartment.

3. The refrigerator according to claim 2, wherein the divider wall is constituted by a mullion having a front surface against a portion of each of the fresh food and freezer doors is adapted to seal, said mullion including a laterally extending segment interconnecting the first and second upright portions.

4. The refrigerator according to claim 3, wherein the freezer door seals against both the first and second upright portions, as well as the laterally extending segment, said freezer door including an upper, outer portion that covers part of the wider, upper portion of the fresh food compartment.

5. The refrigerator according to claim 4, wherein the element comprises an interior panel mounted to the upper, outer portion of the freezer door, said fresh food door sealing against the interior panel to prevent air from leaking out between the fresh food and freezer doors.

6. The refrigerator according to claim 5, wherein the fresh food door seals against the second upright section of the mullion and the interior panel of the freezer door.

7. The refrigerator according to claim 5, wherein the interior panel is pivotable about a vertical axis relative to the freezer door.

8. The refrigerator according to claim 5, wherein the interior panel is mounted to the upper, outer portion of the freezer door between the top edge portion and a laterally extending section, the laterally extending section being located between the top edge portion and the bottom edge portion of the freezer door.

9. In a side-by-side refrigerator including a cabinet shell in which is defined laterally spaced fresh food and freezer compartments having a divider wall therebetween, said fresh food compartment including an upper section having a first lateral dimension and a lower section having a second lateral dimension which is different than the first lateral dimension and said freezer compartment including an upper section having a third lateral dimension and a lower section having a fourth lateral dimension which is different than the third lateral dimension, the improvement comprising: fresh food and freezer doors for sealing the fresh food and freezer compartments, each of the fresh food and freezer doors having a substantially uniform width from top to bottom thereof, wherein, when the fresh food and freezer doors are in closed positions, the freezer door completely seals the freezer compartment, a portion of the freezer door extends beyond the divider wall when closed such that opening of the freezer door exposes at least a portion of each of the fresh food and freezer compartments, and the freezer door includes an element to which the fresh food door, when closed, engages in sealing off the fresh food compartment.

10. The side-by-side refrigerator according to claim 9, wherein each of the fresh food and freezer doors includes first and second, substantially parallel, side edge portions joined by a top edge portion and a bottom edge portion, each of said doors being pivotally mounted relative to the cabinet shell about a respective vertical axis.

11. The side-by-side refrigerator according to claim 10, wherein the fresh food and freezer compartments are separated by the divider wall which constitutes a fore-to-aft extending divider wall, said divider wall including, at frontal portions of the fresh food and freezer compartments, at least first and second interconnected upright portions which are laterally offset.

12. The side-by-side refrigerator according to claim 11, wherein the upper section of the fresh food compartment is wider than the lower section of the fresh food compartment and the upper section of the freezer compartment is narrower than the lower section of the freezer compartment.

13. The side-by-side refrigerator according to claim 12, wherein the divider wall is constituted by a mullion having a front surface against a portion of each of the fresh food and freezer doors is adapted to seal, said mullion including a laterally extending segment interconnecting the first and second upright portions.

14. The side-by-side refrigerator according to claim 13, wherein the freezer door seals against the first upright portion, the second upright portion and the laterally extending segment, said freezer door including an upper, outer portion that covers part of the wider, upper portion of the fresh food compartment.

15. The side-by-side refrigerator according to claim 14, wherein the element is included on the upper, outer portion of the freezer door in the form of an interior panel, said interior panel preventing air from leaking out from the refrigerator between the fresh food and freezer doors.

16. The side-by-side refrigerator according to claim 15, wherein the interior panel is pivotable about a substantially vertical axis relative to the freezer door.

17. The side-by-side refrigerator according to claim 15, wherein the fresh food door seals against the second upright section of the mullion and the interior panel of the freezer door.

* * * * *